US008827332B2

(12) United States Patent
Balay et al.

(10) Patent No.: US 8,827,332 B2
(45) Date of Patent: Sep. 9, 2014

(54) SELF-ENGAGING EMERGENCY EGRESS LOCK ASSEMBLY

(75) Inventors: Tom Balay, Drums, PA (US); Brian Reklaitis, Pittston, PA (US)

(73) Assignee: CIW Enterprises, Mountaintop, PA (US)

( * ) Notice: Subject to any disclaimer, the term of this patent is extended or adjusted under 35 U.S.C. 154(b) by 285 days.

(21) Appl. No.: 13/267,976

(22) Filed: Oct. 7, 2011

(65) Prior Publication Data

US 2013/0088025 A1 Apr. 11, 2013

(51) Int. Cl.

| | |
|---|---|
| ***E05B 15/02*** | (2006.01) |
| ***E05B 65/00*** | (2006.01) |
| ***E05B 47/06*** | (2006.01) |
| *E05B 15/00* | (2006.01) |
| *E05B 65/08* | (2006.01) |
| *E05B 47/00* | (2006.01) |

(52) U.S. Cl.

CPC ..... *E05B 47/0603* (2013.01); *E05B 65/0021* (2013.01); *E05B 65/0847* (2013.01); *E05B 2047/0084* (2013.01); *Y10S 292/36* (2013.01)

USPC ..... 292/341.17; 292/341.15; 292/DIG. 36; 160/201; 160/290.1

(58) Field of Classification Search

CPC ..... E05B 81/06; E05B 81/08

USPC ..... 292/201, 251.5, 341.15–341.17, 292/DIG. 36; 160/201, 290.1

See application file for complete search history.

(56) References Cited

U.S. PATENT DOCUMENTS

| | | | | |
|---|---|---|---|---|
| 1,880,850 | A | | 10/1932 | Dautrick |
| 1,908,165 | A | * | 5/1933 | Moler ..... 160/113 |
| 2,800,348 | A | | 7/1957 | Parsley |
| 3,082,847 | A | | 3/1963 | Young |
| 3,199,153 | A | * | 8/1965 | Weinstein ..... 49/379 |
| 3,258,062 | A | * | 6/1966 | Lambert ..... 160/201 |
| 3,426,829 | A | * | 2/1969 | McDaniel et al. ..... 160/201 |
| 3,894,761 | A | * | 7/1975 | Brennan, Jr. ..... 292/225 |
| 3,955,840 | A | | 5/1976 | Rawls et al. |
| 4,130,156 | A | | 12/1978 | Wardlaw |
| 4,211,443 | A | | 7/1980 | Butts et al. |
| 4,268,076 | A | * | 5/1981 | Itoi ..... 292/216 |
| 4,782,674 | A | * | 11/1988 | Johnson ..... 70/95 |
| 5,022,691 | A | * | 6/1991 | Clay, Jr. ..... 292/121 |
| 5,076,625 | A | | 12/1991 | Oxley |

(Continued)

FOREIGN PATENT DOCUMENTS

| | | |
|---|---|---|
| EP | 0959222 | 11/1999 |
| WO | 2004015231 | 2/2004 |

*Primary Examiner* — Carlos Lugo

(74) *Attorney, Agent, or Firm* — Mitchell A. Smolow

(57) ABSTRACT

A self-engaging emergency egress lock assembly mounted to a door track is described. As a door lock strike element contacts a lock strike assembly contained within the door lock assembly, the strike assembly hinges over the door lock strike element. When the door reaches a predetermined down limit power is applied to activate an actuator. Upon activation, the actuator engages a lock strike stop which prevent the strike assembly from disengaging the door lock strike element. If the door is attempted to be opened while the lock strike stop is engaged, the lock strike assembly pushes against the stop, preventing the door from traveling upward. In an emergency egress (alarm) condition, power to the actuator is terminated, thereby releasing the lock strike stop and by extension, the strike assembly, thus disengaging the door lock strike element, thereby providing emergency egress capability.

26 Claims, 6 Drawing Sheets

(56) References Cited

U.S. PATENT DOCUMENTS

| | | | | | |
|---|---|---|---|---|---|
| 5,355,741 | A | | 10/1994 | Hsieh | |
| 5,386,891 | A | | 2/1995 | Shea | |
| 5,533,561 | A | * | 7/1996 | Forehand, IV | 160/188 |
| 5,573,050 | A | | 11/1996 | Henkenjohann | |
| 5,575,515 | A | * | 11/1996 | Iwamoto et al. | 292/341.17 |
| 5,579,878 | A | | 12/1996 | Hsieh | |
| 5,704,663 | A | * | 1/1998 | Clay, Jr. | 292/198 |
| 5,720,333 | A | * | 2/1998 | Turvey | 160/290.1 |
| 5,839,555 | A | | 11/1998 | Hsieh | |
| 5,839,766 | A | | 11/1998 | Iannuzzi et al. | |
| 5,848,631 | A | | 12/1998 | DeGiovanni et al. | |
| 5,903,114 | A | | 5/1999 | Miller et al. | |
| 6,014,307 | A | | 1/2000 | Crimmins | |
| 6,027,148 | A | | 2/2000 | Shoemaker | |
| 6,047,576 | A | | 4/2000 | Lanigan et al. | |
| 6,076,870 | A | | 6/2000 | Frolov | |
| 6,139,073 | A | * | 10/2000 | Heffner et al. | 292/201 |
| 6,382,005 | B1 | | 5/2002 | White et al. | |
| 6,412,539 | B1 | | 7/2002 | Kuribayashi et al. | |
| 6,427,749 | B1 | * | 8/2002 | Swink et al. | 160/188 |
| 6,484,784 | B1 | | 11/2002 | Weik, III et al. | |
| 6,834,464 | B2 | | 12/2004 | Shoemaker | |
| 7,032,418 | B2 | | 4/2006 | Martin et al. | |
| 7,032,936 | B2 | * | 4/2006 | Promutico | 292/95 |
| 7,059,159 | B2 | | 6/2006 | Lanigan et al. | |
| 7,114,753 | B2 | * | 10/2006 | Nodorft | 292/137 |
| 7,275,631 | B2 | | 10/2007 | Hsieh | |
| 7,296,830 | B2 | | 11/2007 | Koveal et al. | |
| 7,299,847 | B1 | | 11/2007 | Evans | |
| 7,448,426 | B2 | | 11/2008 | Hsieh | |
| 7,603,882 | B2 | | 10/2009 | Carbajal et al. | |
| 8,347,666 | B2 | * | 1/2013 | Stendal | 70/99 |
| 8,496,275 | B2 | * | 7/2013 | Garneau et al. | 292/201 |
| 2008/0224481 | A1 | | 9/2008 | Geringer et al. | |

* cited by examiner

SELF-ENGAGING EMERGENCY EGRESS LOCK ASSEMBLY

FIELD OF THE INVENTION

This invention relates generally to emergency egress, and in particular, to a self-engaging door lock assembly which will release when in an alarm condition.

BACKGROUND OF THE INVENTION

By code, buildings such as industrial, school and public buildings require emergency egress capability. Access openings, such as entranceways, doorways and hallways are often secured by either overhead (vertically traveling) closures or accordion folding (horizontally traveling) closures.

Overhead closures travel within a pair of tracks mounted at opposite sides of the access opening. Segmented panel overhead closures are comprised of hinged panels which pivot relative to one another as they successively shift through an arcuate path as the closure opens and closes. Single panel closures are comprised of a single panel capable of arcuate movement to an open position in which the panel is generally disposed in a horizontal position parallel to the floor upon full opening. Both segmented and single panel overhead closures are usually provided with rollers mounted to the panel(s) which extend laterally from the panel(s) to engage and roll within the tracks.

Overhead coiling closures, also referred to as rolling steel doors, move in a generally vertical path, coiling above the opening as the door is opened. They travel within a pair of tracks positioned on either side of the opening. Rollers are usually not utilized. Because rolling steel doors have many fewer parts than sectional doors, with less risk for damage and inoperability, they make a better solution for facilities that cannot afford opening downtime. For emergency egress applications, downtime, i.e. an inoperable door, can be life threatening.

Accordion folding closures are mounted to an overhead horizontally positioned track.

Regardless of the type of closure, for emergency egress applications any locking mechanism used to secure the closure must automatically release when in an alarm condition regardless of the locking mechanism's power state.

Often times the closures is operated by a powered door operator which also provides locking capability. However, for many applications the locking capability provided by the operator is not sufficient. Consequently it is necessary to provide additional locking to achieve required security.

Accordingly, there is still a continuing need for improved locking assembly designs that will release when in an alarm condition. The present invention fulfills this need and further provides related advantages.

BRIEF SUMMARY OF THE INVENTION

A lock assembly is mounted to a door track. The operative geometry of the locking assembly is such that as a door lock strike element contacts a lock strike assembly contained within the lock assembly, the strike assembly hinges over the door lock strike element. When the door reaches a predetermined down limit power is applied to activate an actuator. Upon activation, the actuator engages a lock strike stop which prevent the strike assembly from disengaging the door lock strike element.

If the door is attempted to be opened while the lock strike stop is engaged, the lock strike assembly pushes against the stop, preventing the door from traveling upward. In an emergency egress (alarm) condition, power to the actuator is terminated, thereby releasing the lock strike stop and by extension, the strike assembly, thus disengaging the door lock strike element, thereby providing emergency egress capability.

One advantage of the locking assembly is the ability to provide additional security while maintaining fail safe emergency egress capability.

A second advantage is the ability to use the locking assembly with both vertically and horizontally positioned tracks.

Other features and advantages of the present invention will be apparent from the following more detailed description of the preferred embodiments, taken in conjunction with the accompanying drawings which illustrate, by way of example, the principles of the invention.

BRIEF DESCRIPTION OF THE DRAWINGS

The accompanying drawings are included to provide a further understanding of the present invention. These drawings are incorporated in and constitute a part of this specification, illustrate one or more embodiments of the present invention, and together with the description, serve to explain the principles of the present invention.

Figure 1:
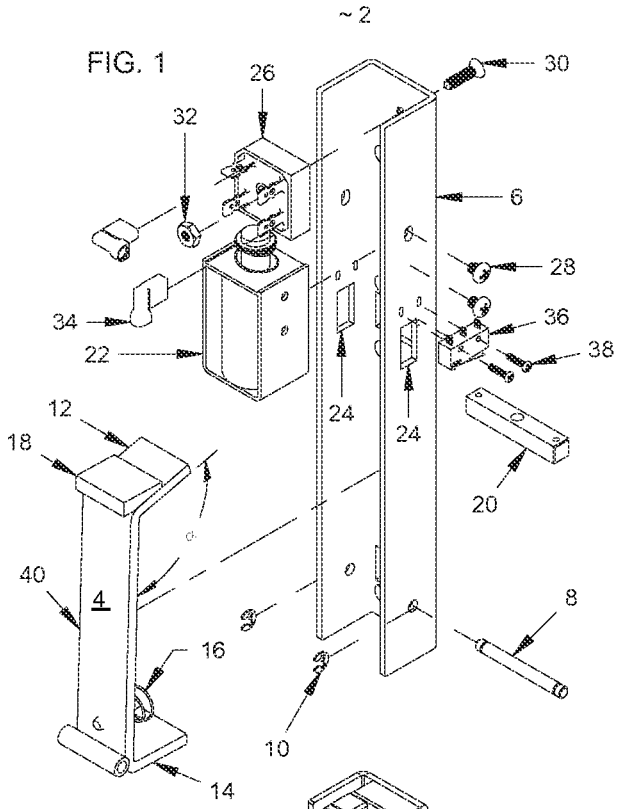
FIG. 1 is an exploded perspective view of a lock assembly.
Figure 3:
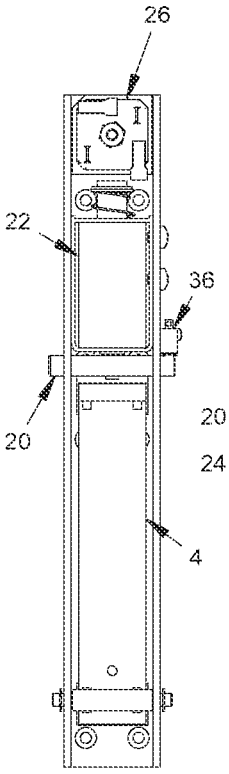
FIG. 3 is a front view of a lock assembly.
Figure 4:
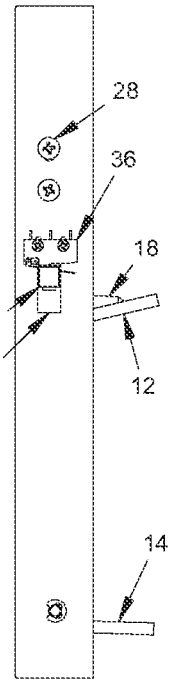
FIG. 4 is a side view of a lock assembly in an engaged position.
Figure 2:
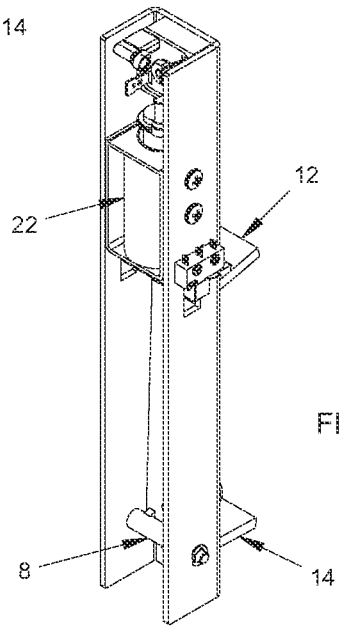
FIG. 2 is a perspective view of a lock assembly in an engaged position.
Figure 5:
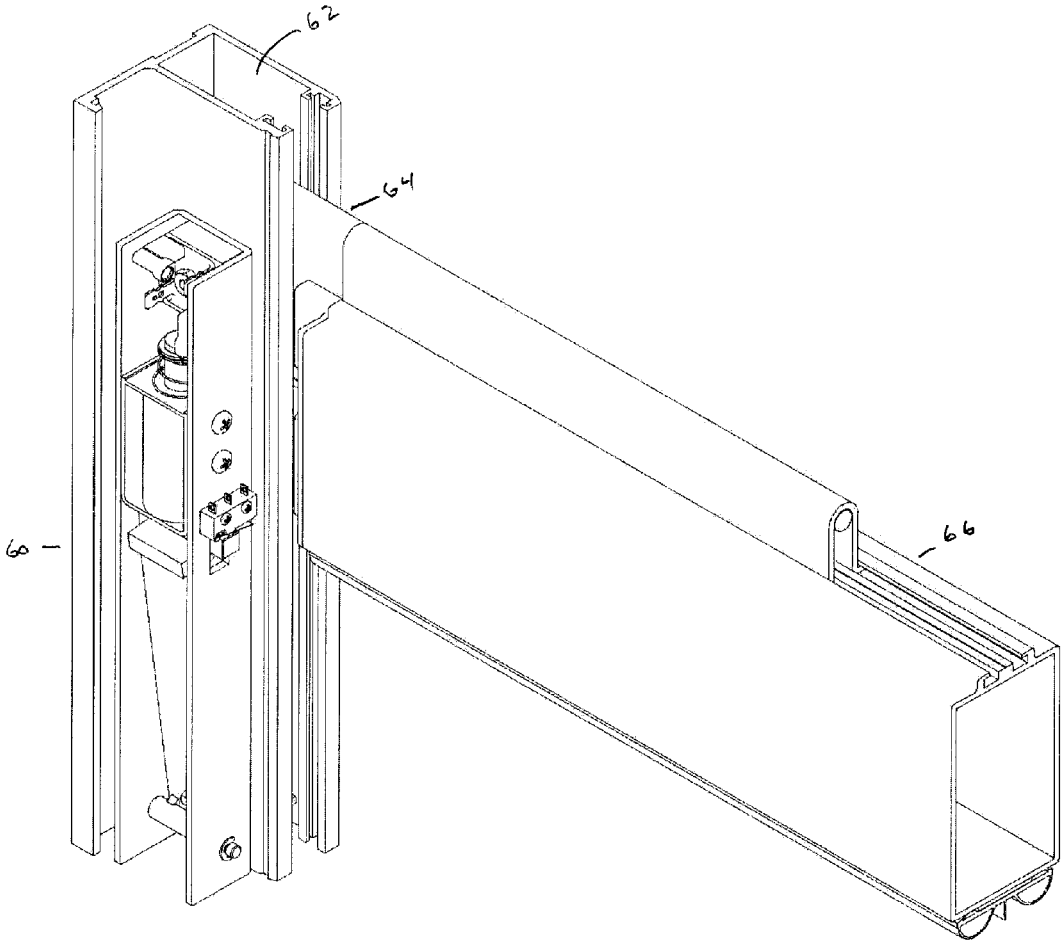
FIG. 5 is a perspective view of a lock assembly mounted to a door track in a non-engaged position.
Figure 6:
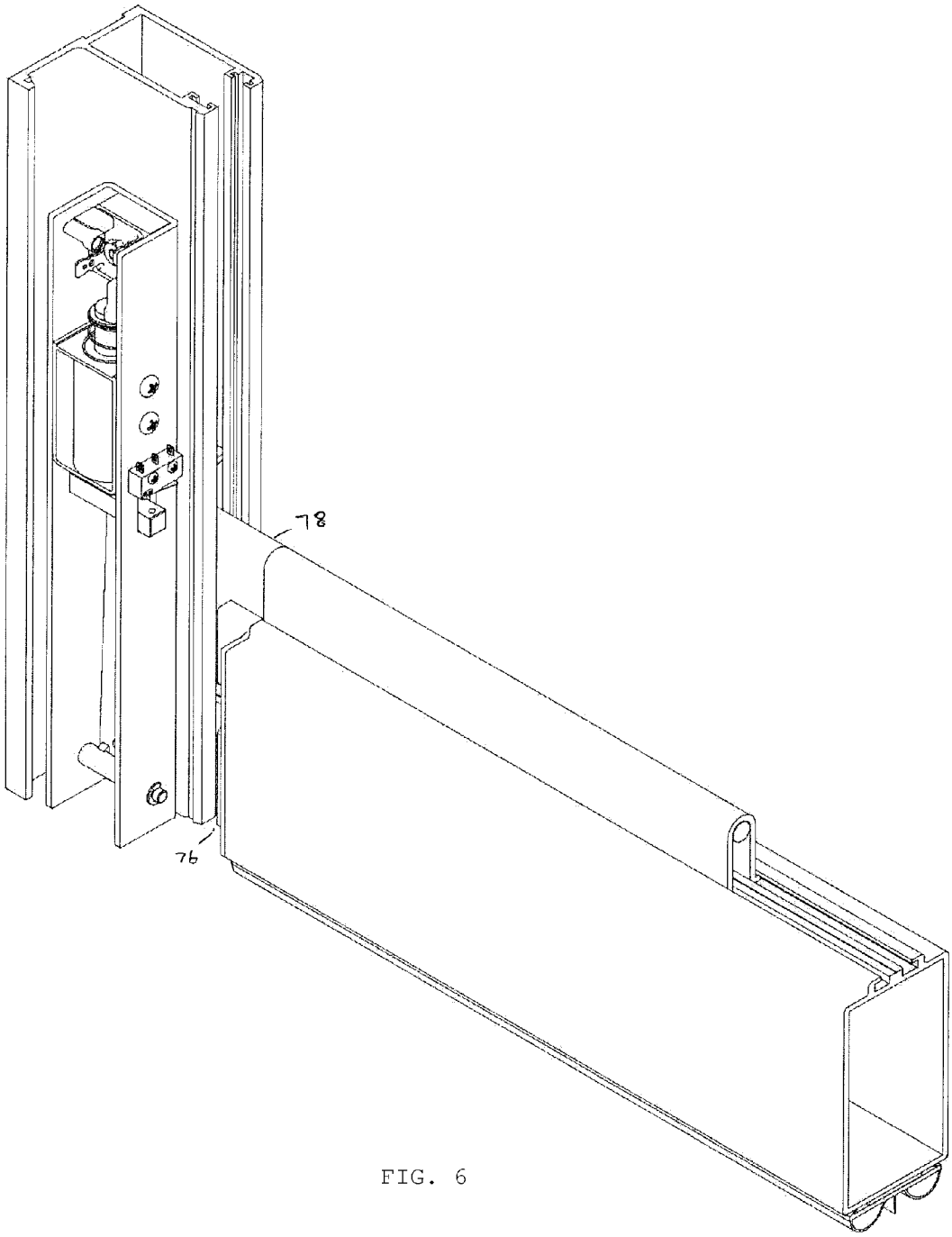
FIG. 6 is a perspective view of a lock assembly mounted to a door track in an engaged position.
Figure 7:
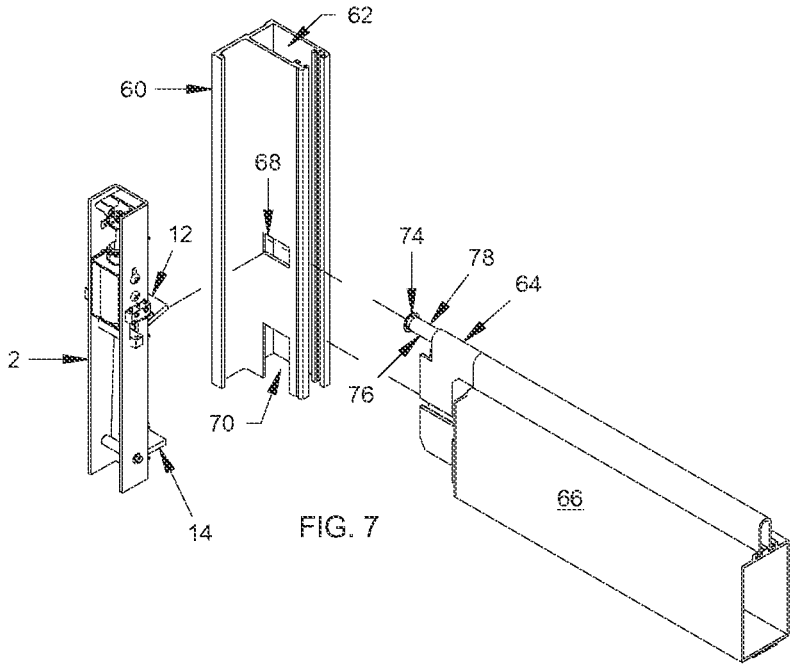
FIG. 7 is an exploded perspective view of a lock assembly, door track and door channel element.

Other features and advantages will be apparent from the following more detailed description of the preferred embodiments, taken in conjunction with the accompanying drawings which illustrate, by way of example, the principles of the invention.

DETAILED DESCRIPTION OF THE INVENTION

As required, detailed embodiments are disclosed; however, it is to be understood that the disclosed embodiments are merely exemplary of the invention that may be embodied in various forms. The figures are not necessary to scale, and some features may be exaggerated to show details of particular components. Therefore, specific structural and functional details disclosed are not to be interpreted as limiting, but merely as a basis for the claims and as a representative basis for teaching one skilled in the art to variously employ the present invention.

While an overhead coiling (rolling steel) door is described as an exemplar, the locking assembly is not limited to an overhead coiling door. One skilled in the art can readily visualize that the door lock strike element may be, for example, the roller of a segmented door or the hanger of an accordion folding door.

Turning now to FIGS. 1-4, FIG. 1 represents the component parts of the lock assembly 2. Lock strike assembly 4 is hingably attached to channel 6 using hinge pin 8 and E-rings 10. Lock strike assembly 4 comprises upper flange 12 and lower flange 14 extending from body 40, an optional return element exerting a return force on the body, for example a spring 16, and actuator stop 18. Upper flange 12 form angle α with body 40.

Strike stop 20 is mounted to bottom of an actuator, for example, solenoid 22 such that strike stop 20 travels within elongated openings 24 of channel 6 as solenoid 22 is energized/de-energized. Solenoid 22 is in electrical communication with a receiver, for example, a rectifier 26 in known fashion (not shown). Solenoid 22 is mounted to channel 6 with screws 28, and rectifier 26 is mounted to channel 6 with bolt 30 and nut 32. Flag terminals 34 are utilized with rectifier 26 to provide electrical communication to an alarm condition/lock release signal generator (not shown).

Figure 11:
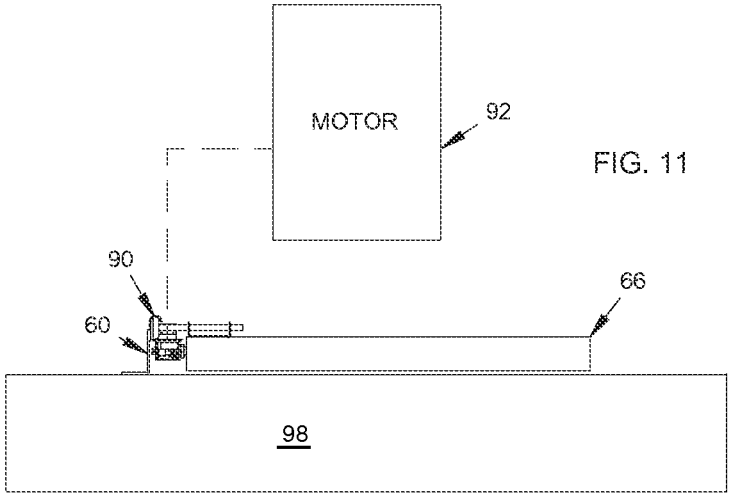
FIG. 11 is an overhead view of a door system with an operator shown schematically.
Figure 8:
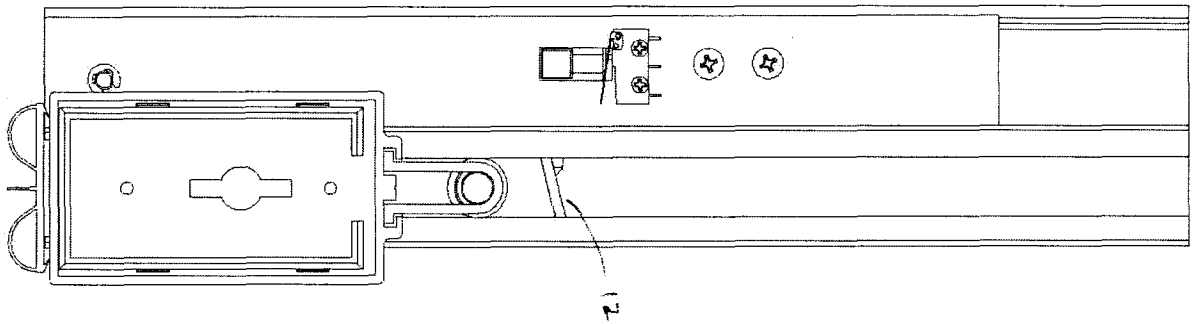
FIG. 8 is a side view of a lock assembly mounted to a door track in an engaged position.
Figure 10:
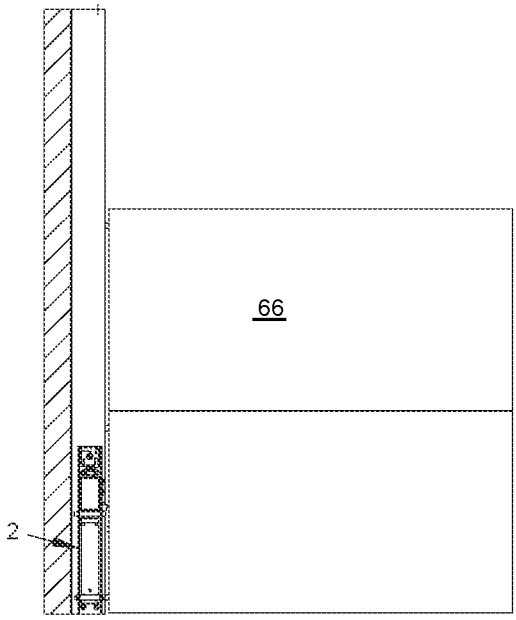
FIG. 10 is a front view of a door system.

Optional switch 36 is mounted to channel 6 with screws 38. Switch 36 is in electrical communication with and is used to control the door operator 92 (FIGS. 10-11).

Figure 9:
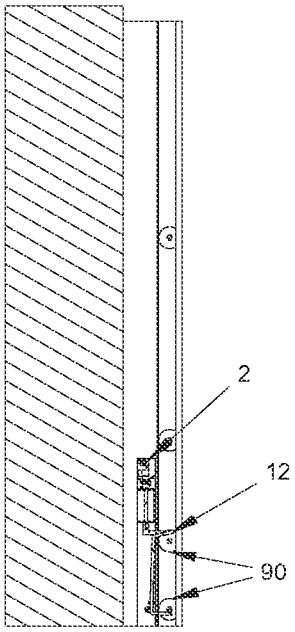
FIG. 9 is a side view of a door system using rollers.

Turning now to FIGS. 5-8, lock assembly 2 is mounted to a door track 60, for example, using screws (not shown). Door track 60 is mounted to building structure (FIG. 11). Door track 60 comprises track channel 62, used to movably receive door channel element 64. Door channel element 64 extends from the door closure 66, comprises a door lock strike element 74, and moves within track channel 62 as the door closure 66 is opened and closed. Door closure 66 may be, for example, a coiling door, a single panel, or a plurality of hinged panels. In this overhead coiling door exemplar, door channel element 64 is an extension of door closure 66 shaped to slidingly fit within track channel 62, and the door lock strike element 74 has a leading edge 76 and trailing edge 78. However, it should be appreciated that other door lock strike element operative forms may be used, for example, rollers 90 (FIG. 9) or door hangers used in an overhead track (not shown).

Door track 60 further comprises upper slot 68 and lower slot 70 used to operatively receive upper flange 12 and lower flange 14, respectively.

In use, the self-engaging emergency egress lock assembly operates as follows:

The lock assembly 2 is mounted to the door track 60 which is mounted to the door opening (not shown). In an unlocked state, solenoid 22 is de-energized which allows spring 16 to rotatably withdraw upper flange 12 from track channel 62. Lower flange 14 remains extended within track channel 62.

As the door closure 66 is closed, for example, using a powered operator, the door lock strike element 74 (door channel element leading edge 76) bypasses the retracted upper flange 12 and continues to close until it engages the lower flange 14, causing the lock strike assembly 4 to rotatively hinge such that the upper flange 12 reinserts into track channel 62 and extends over the door lock strike element 74 (door channel trailing edge 78), thereby preventing opening travel of the door closure 66.

When the door closure 66 reaches a predetermined down limit, the solenoid 22 is energized. Upon activation, the solenoid 22 engages the lock strike stop 20, causing it to travel within elongated openings 24 to engage actuator stop 18, which prevents the lock strike assembly 4 from rotating to the unlocked position (retraction of the upper flange 12) and disengagement of the door lock strike element 74.

If opening of the door closure 66 is attempted while the strike stop 20 is obstructively engaging the actuator stop 18, the lock strike assembly 4 is pushed against the strike stop 20, which prevents the lock strike assembly 4 from rotating to its unlocked position and disengaging the door lock strike element 74. In this manner it prevents the door closure 66 from traveling upward.

In an emergency egress (alarm) condition or when a manual unlock signal is generated the solenoid 22 (actuator) is de-energized, thereby retracting the strike stop 20, allowing the spring 16 to bring the lock strike assembly 4 to an unlocked state (retraction of upper flange 12), thus disengaging the door lock strike element 74 and allowing the door closure 66 to open. In this manner emergency egress capability is insured.

Upper flange 12 angle α (FIG. 1) is an obtuse angle so that door lock strike element 74 will cause rotative retraction of upper flange 12 as door closure 66 opens. To further insure lock strike assembly 4 disengagement, optional return element 16 (spring) further aids in maintaining rotative retraction of upper flange 12.

When optional switch 36 (operatively connected to the operator) is utilized, switch 36 disables the operative connection to the operator when the lock strike stop 20 is in its locked position, thereby preventing operator damage if it were to try to power open the door closure 66 while the lock assembly 2 is engaged.

A self-engaging lock assembly without emergency egress capability, where the assembly remains in the locked position regardless of power state, can be achieved by omitting or disabling the ability to receive the unlock signal. One example would be to use a manually retractable plunger rather than a solenoid for the activator. This would have application, for example, in loading dock type doors, where emergency egress is not required but security is desired.

Although the present invention has been described in connection with specific examples and embodiments, those skilled in the art will recognize that the present invention is capable of other variations and modifications within its scope. For example, while an overhead coiling door has been used as an exemplar, the operative principles can also be applied to any door utilizing a tracked design.

These examples and embodiments are intended as typical of, rather than in any way limiting on, the scope of the present invention as presented in the appended claims.

What is claimed is:

1. A self-engaging door lock assembly comprising:

a lock strike assembly hingably attached to a channel, the lock strike assembly comprising an upper flange and a lower flange extending from a lock strike assembly body, an angle formed by the upper flange and the lock strike assembly body being obtuse;

an actuator stop fixed to the lock strike assembly body; and a strike stop mounted to an actuator, the strike stop engaging the actuator stop when the actuator is activated;

wherein the lock strike assembly is hinged for allowing the upper flange and lower flange to reversibly, retentively receive a door lock strike element.

2. The door lock assembly of claim 1 further comprising a return element exerting a return force on the lock strike assembly body.

3. The door lock assembly of claim 2 wherein the return element is a spring mounted between the lock strike assembly body and the channel.

4. The door lock assembly of claim 1 further comprising a switch mounted to the channel for controlling a door operator.

5. The door lock assembly of claim 1 wherein the actuator is a solenoid.

6. The door lock assembly of claim 1 wherein the strike stop travels within elongated channel openings as the actuator is activated/deactivated.

7. The door lock assembly of claim 1 wherein the lock strike assembly is hinged for allowing a door lock strike element leading edge to bypass a retracted upper flange to engage the lower flange; thereby rotatively hinging the lock strike assembly to extend the upper flange for reversibly retaining the door lock strike element.

8. A self-engaging door lock assembly comprising:

a lock strike assembly hingably attached to a channel, the lock strike assembly comprising an upper flange and a lower flange extending from a lock strike assembly body, an angle formed by the upper flange and the lock strike assembly body being obtuse;

an actuator stop fixed to the lock strike assembly body; and a strike stop mounted to an actuator, the strike stop engaging the actuator stop when the actuator is activated;

the lock strike assembly hinged for allowing the upper flange and lower flange to reversibly, retentively receive a door lock strike element;

wherein the actuator is deactivated upon receiving an unlock signal.

9. The door lock assembly of claim 8 further comprising a return element exerting a return force on the lock strike assembly body.

10. The door lock assembly of claim 9 wherein the return element is a spring mounted between the lock strike assembly body and the channel.

11. The door lock assembly of claim 8 further comprising a switch mounted to the channel for controlling a door operator.

12. The door lock assembly of claim 8 wherein the actuator is a solenoid.

13. The door lock assembly of claim 8 wherein the strike stop travels within elongated channel openings as the actuator is activated/deactivated.

14. The door lock assembly of claim 8 wherein the lock strike assembly is hinged for allowing a door lock strike element leading edge to bypass a retracted upper flange to engage the lower flange; thereby rotatively hinging the lock strike assembly to extend the upper flange for reversibly retaining the door lock strike element.

15. A method for self-locking a door comprising:

providing a door having a door channel element movably received by a door track;

mounting a door lock assembly to the door track, the door lock assembly comprising:

a lock strike assembly hingably attached to a channel, the lock strike assembly comprising an upper flange and a lower flange extending from a lock strike assembly body, an angle formed by the upper flange and the lock strike assembly body being obtuse;

an actuator stop fixed to the lock strike assembly body; and a strike stop mounted to an actuator, the strike stop engaging the actuator stop when the actuator is activated;

the lock strike assembly hinged to allow the upper flange and lower flange to reversibly, retentively receive a door lock strike element;

activating the actuator to prevent the disengagement of the upper flange, thereby locking the door.

16. The method of claim 15 further comprising the step of providing a signal to deactivate the actuator to unlock the door.

17. The method of claim 15 wherein the door lock assembly further comprises a return element exerting a return force on the lock strike assembly body.

18. The method of claim 15 further comprising a switch mounted to the channel for controlling a door operator.

19. The method of claim 15 wherein the strike stop travels within elongated channel openings as the actuator is activated/deactivated.

20. An overhead door system comprising:

a track;

a door closure movably contained within the track; and a self-engaging door lock assembly mounted to the track comprising:

a lock strike assembly hingably attached to a channel, the lock strike assembly comprising an upper flange and a lower flange extending from a lock strike assembly body, an angle formed by the upper flange and the lock strike assembly body being obtuse;

an actuator stop fixed to the lock strike assembly body; and a strike stop mounted to an actuator, the strike stop engaging the actuator stop when the actuator is activated;

the lock strike assembly hinged to allow the upper flange and lower flange to reversibly, retentively receive a door lock strike element.

21. The door system of claim 20 further comprising a return element exerting a return force on the lock strike assembly body.

22. The door system of claim 21 wherein the return element is a spring mounted between the lock strike assembly body and the channel.

23. The door system of claim 20 wherein the door lock strike element is an element selected from the group consisting of an extension of the door closure shaped to slidingly fit within the track, and a roller.

24. The door system of claim 20 further comprising a receiver in communication with the actuator for receiving a signal to deactivate the actuator.

25. The door system of claim 20 wherein the strike stop travels within elongated channel openings as the actuator is activated/deactivated.

26. The overhead door system of claim 20 wherein the lock strike assembly is hinged for allowing a door lock strike element leading edge to bypass a retracted upper flange to engage the lower flange; thereby rotatively hinging the lock strike assembly to extend the upper flange for reversibly retaining the door lock strike element.

* * * * *